US012358741B2

(12) United States Patent
Kannari et al.

(10) Patent No.: US 12,358,741 B2
(45) Date of Patent: Jul. 15, 2025

(54) SHEET FEEDING APPARATUS, IMAGE FORMING SYSTEM, AND IMAGE FORMING APPARATUS

(71) Applicant: CANON KABUSHIKI KAISHA, Tokyo (JP)

(72) Inventors: Isao Kannari, Saitama (JP); Hiroshi Saito, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 188 days.

(21) Appl. No.: 18/307,090

(22) Filed: Apr. 26, 2023

(65) Prior Publication Data

US 2023/0365365 A1 Nov. 16, 2023

(30) Foreign Application Priority Data

May 10, 2022 (JP) ..... 2022-077708

(51) Int. Cl.
*B65H 3/08* (2006.01)
*B65H 1/14* (2006.01)
*B65H 7/02* (2006.01)

(52) U.S. Cl.
CPC ..... *B65H 3/08* (2013.01); *B65H 1/14* (2013.01); *B65H 7/02* (2013.01); *B65H 2404/20* (2013.01); *B65H 2406/10* (2013.01); *B65H 2515/81* (2013.01)

(58) Field of Classification Search
CPC ..... B65H 1/04; B65H 1/14; B65H 2406/10; B65H 2515/81; B65H 2404/20; B65H 7/02; B65H 3/08; B65H 3/48; B65H 3/128; B65H 3/0808; B65H 3/0816; B65H 3/124; B65H 3/14
USPC ..... 271/11, 12, 97, 98
See application file for complete search history.

(56) References Cited

U.S. PATENT DOCUMENTS

| | | | | |
|---|---|---|---|---|
| 8,302,959 | B2 * | 11/2012 | Ikeuchi | B65H 1/14 271/154 |
| 8,419,008 | B2 | 4/2013 | Ikeda et al. | |
| 8,608,157 | B2 * | 12/2013 | Fujikura | B65H 3/0883 271/106 |
| 11,661,292 | B2 * | 5/2023 | Harada | B65H 1/04 271/126 |
| 12,091,269 | B2 * | 9/2024 | Takamiya | B65H 7/20 |
| 12,214,990 | B2 * | 2/2025 | Nakano | B65H 1/14 |

FOREIGN PATENT DOCUMENTS

JP 2010195588 A 9/2010

* cited by examiner

*Primary Examiner* — Leslie A Nicholson, III
(74) *Attorney, Agent, or Firm* — ROSSI, KIMMS & McDOWELL LLP

(57) ABSTRACT

A sheet feeding apparatus includes a tray configured to support a sheet, a lifting unit configured to raise and lower the tray, an air blowing unit configured to blow air to a side edge of the sheet supported by the tray to float the sheet, an attraction and conveyance unit configured to execute a feeding operation of attracting and feeding the floated sheet, an upper surface detection unit configured to detect a lower state where an upper surface of the sheet is below a detection position, and a control unit configured to control the lifting unit and the attraction and conveyance unit. The control unit is configured to execute a mode in which the tray is raised by the lifting unit for a second time longer than a first time in which the lower state is detected.

11 Claims, 9 Drawing Sheets

SHEET FEEDING APPARATUS, IMAGE FORMING SYSTEM, AND IMAGE FORMING APPARATUS

BACKGROUND OF THE INVENTION

Field of the Invention

The present invention relates to a sheet feeding apparatus that feeds a sheet, an image forming system, and an image forming apparatus.

Description of the Related Art

For example, an image forming apparatus such as a printer or a copier or an image forming system includes a sheet feeding apparatus such as a feeding cassette or a feeding deck that feeds a sheet to an image forming unit that forms an image on a sheet. In such a sheet feeding apparatus, there has been proposed an apparatus in which air is blown to a sheet bundle supported on a tray to float a plurality of upper sheets, only one sheet is attracted to an attraction and conveyance belt arranged above the sheet bundle, and the sheet is conveyed (see JP 2010-195588 A).

The sheet feeding apparatus of JP 2010-195588 A includes a first sheet surface sensor that is disposed above the tray and detects the upper surface of the uppermost sheet, and a second sheet surface sensor that is disposed upstream in the sheet feeding direction and detects the upper surface at the trailing edge of the uppermost sheet. Then, by feeding the sheet, the upper surface of the uppermost sheet in the tray becomes lower than a reference position, and when the first sheet surface sensor and the second sheet surface sensor detect this state, the tray is raised up to the reference position based on the detection from these sensors. As a result, the height of the upper surface of the sheet is controlled to be a position within an appropriate range.

Meanwhile, for example, in a case where the sheet is a sheet having low stiffness such as plain paper, when the sheet is floated by air, the trailing edge of the sheet upstream in the sheet feeding direction sags. The second sheet surface sensor sets the reference position in consideration of the fact that the trailing edge of the sheet sags as described above. As a result, the height of the upper surface of the sheet is controlled to be a position within an appropriate range.

However, for example, when the sheet is a sheet having high stiffness such as thick paper, the trailing edge of the floated sheet is less likely to sag. For this reason, there is a problem that the time during which the second sheet surface sensor detects that the trailing edge of the sheet is below the reference position is shortened, the raising of the tray is insufficient, and the number of floating sheets is reduced, so that feeding failure of the sheet occurs.

SUMMARY OF THE INVENTION

According to a first aspect of the present invention, a sheet feeding apparatus includes a tray configured to be raised and lowered and support a sheet, a lifting unit configured to raise and lower the tray, an air blowing unit configured to blow air to a side edge of the sheet supported by the tray to float the sheet, an attraction and conveyance unit configured to execute a feeding operation of attracting and feeding the floated sheet, an upper surface detection unit configured to detect a lower state where an upper surface of the sheet is below a detection position, and a control unit configured to control the lifting unit and the attraction and conveyance unit. The control unit is configured to execute a mode in which the tray is raised by the lifting unit for a second time longer than a first time in which the lower state is detected.

According to a second aspect of the present invention, a sheet feeding apparatus includes a tray configured to be raised and lowered and support a sheet, a lifting unit configured to raise and lower the tray, an air blowing unit configured to blow air to a side edge of the sheet supported by the tray to float the sheet, an attraction and conveyance unit configured to execute a feeding operation of attracting and feeding the floated sheet, an upper surface detection unit configured to output a signal indicating that an upper surface of the floated sheet is below a detection position, and a control unit configured to control the lifting unit and the attraction and conveyance unit. The control unit is configured to execute a mode in which the lifting unit starts raising the tray in response to the output of the signal and stops raising the tray in response to elapse of a set time set in accordance with a thickness of the sheet is executed.

According to a third aspect of the present invention, an image forming system includes a sheet feeding unit including a tray configured to be raised and lowered and support a sheet, a lifting unit that raises and lowers the tray, an air blowing unit that blows air to a side edge of the sheet supported by the tray to float the sheet, an attraction and conveyance unit configured to execute a feeding operation of attracting and feeding the floated sheet, and an upper surface detection unit that detects a lower state where an upper surface of a sheet is below a detection position, and an image forming apparatus including an image forming unit that forms an image on a sheet fed from a sheet feeding apparatus; and a control unit that controls the lifting unit and the attraction and conveyance unit. The control unit is configured to execute a mode in which the tray is raised by the lifting unit for a second time longer than a first time in which the lower state is detected.

According to a fourth aspect of the present invention, An image forming apparatus includes a sheet feeding unit including a tray configured to be raised and lowered and support a sheet, a lifting unit that raises and lowers the tray, an air blowing unit that blows air to a side edge of the sheet supported by the tray to float the sheet, an attraction and conveyance unit configured to execute a feeding operation of attracting and feeding the floated sheet, and an upper surface detection unit that detects a lower state where an upper surface of a sheet is below a detection position, an image forming unit configured to form an image on a sheet fed from a sheet feeding apparatus, and a control unit configured to control the lifting unit and the attraction and conveyance unit. The control unit is configured to execute a mode in which the tray is raised by the lifting unit for a second time longer than a first time in which the lower state is detected.

Further features of the present invention will become apparent from the following description of exemplary embodiments with reference to the attached drawings.

DESCRIPTION OF THE EMBODIMENTS

Hereinafter, exemplary embodiments for carrying out the present invention will be described with reference to the drawings.

Overall Configuration of Image Forming System

Figure 1:
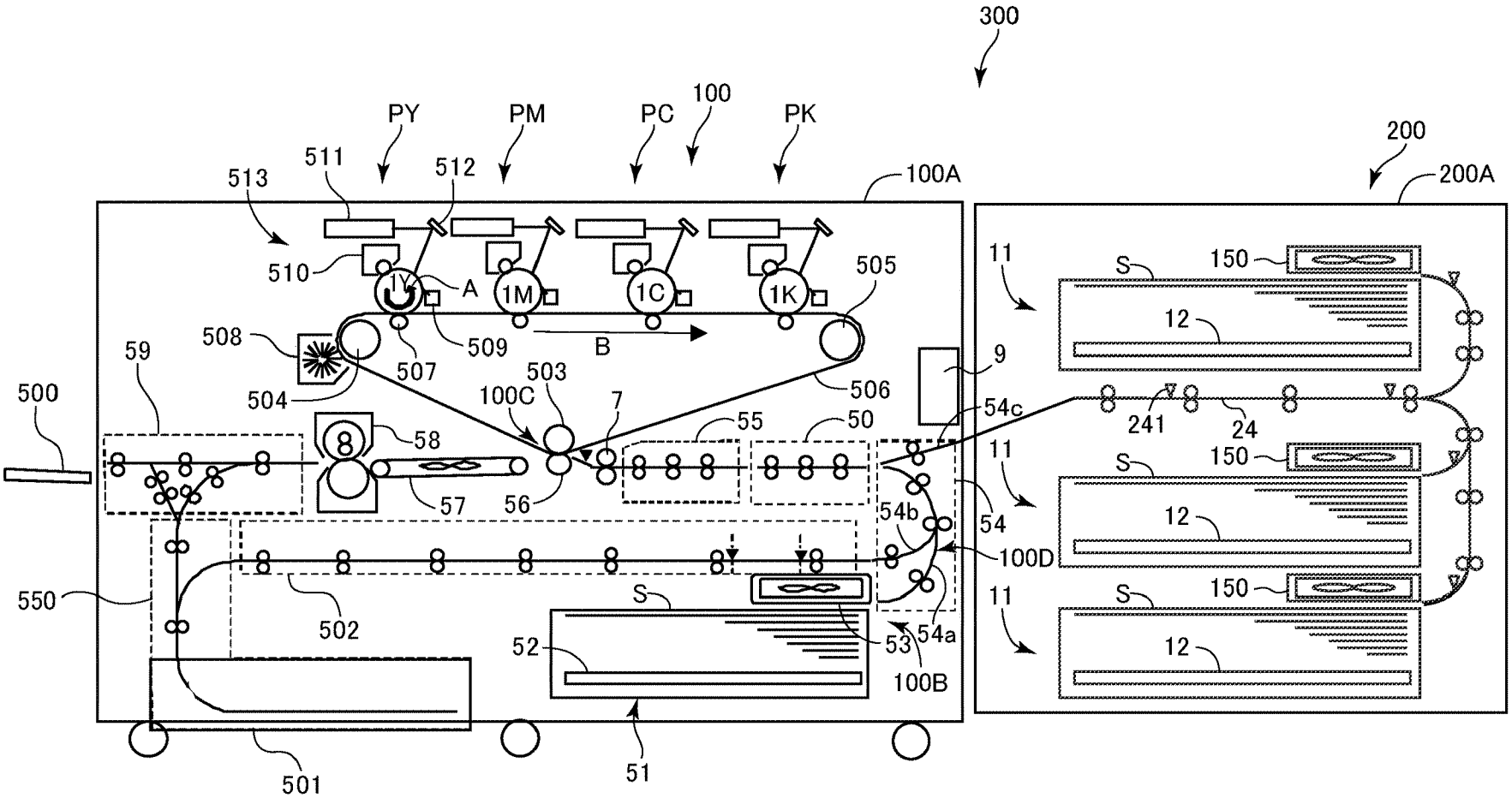
FIG. 1 is a schematic view illustrating an image forming system according to the present embodiment.

First, a schematic configuration of an image forming system 300 including a feeding deck 200 constituting a sheet feeding apparatus according to the present embodiment will be described. FIG. 1 is a schematic configuration diagram of an image forming system. As illustrated in FIG. 1, the image forming system 300 includes a printer 100 as an image forming apparatus that forms an image on a sheet, and the feeding deck 200 that supplies a sheet to a printer 1. Note that, as the sheet used as a recording medium, various sheets such as paper such as a paper sheet and an envelope, glossy paper, a plastic film such as a sheet for an overhead projector, and cloth can be used.

Configuration of Image Forming Apparatus

As illustrated in FIG. 1, the printer 100 includes a control unit 9 that controls the entire operation of the printer 100 on the basis of image information input from an external PC or image information read from a document. An apparatus body 100A of the printer 1 accommodates a sheet cassette 51 that accommodates the sheet S, and an image forming engine 513 that forms an image on the sheet S fed from the sheet cassette 51. The image forming engine 513, which is an example of an image forming unit, includes four image forming process units PY, PM, PC, and PK that form toner images of yellow, magenta, cyan, and black, respectively, and an intermediate transfer belt 506. The image forming engine 513 forms an image on the sheet S by a tandem-type intermediate transfer system. The image forming process units PY to PK are electrophotographic units having photosensitive drums 1Y, 1M, 1C, and 1K, respectively, which are photosensitive members.

The image forming process units PY to PK have a common configuration except that the colors of toners used for development are different. Here, the configuration of the image forming engine 513 and the image forming process of the toner image will be described using the yellow image forming process unit PY as an example. The image forming process unit PY includes an exposing unit 511, a developing unit 510, and a drum cleaner 509 in addition to the photosensitive drum 1Y. The photosensitive drum 1Y is a drum-shaped photosensitive member having a photosensitive layer on an outer peripheral portion, and rotates in a direction (arrow A in FIG. 1) along a rotation direction (arrow B in FIG. 1) of the intermediate transfer belt 506. The surface of the photosensitive drum 1Y is charged by receiving a charge supplied from a charging unit such as a charging roller. The exposing unit 511 irradiates the photosensitive drum 1Y with laser light modulated according to image information, scans the photosensitive drum 1Y with an optical system including a reflection device 512, and draws an electrostatic latent image on the surface of the photosensitive drum 1Y. The developing unit 510 contains a developer containing toner, and supplies the toner to the photosensitive drum 1Y to visualize the electrostatic latent image as a toner image. The toner image formed on the photosensitive drum 1Y is primarily transferred to the intermediate transfer belt 506 at a primary transfer portion which is a nip portion between the primary transfer roller 507 and the intermediate transfer belt 506. The residual toner remaining on the photosensitive drum 1Y after the transfer is removed by the drum cleaner 509.

The intermediate transfer belt 506 is wound around a driving roller 504, a driven roller 505, a secondary transfer inner roller 503, and a primary transfer roller 507, and is rotationally driven in a clockwise direction (arrow B) in FIG. 1 by the driving roller 504. The image forming process described above is performed in parallel in the image forming process units PY to PK, and the toner images of the four colors are multi-layer transferred so as to be superimposed on each other, and a full-color toner image is formed on the intermediate transfer belt 506. The toner image is conveyed to a secondary transfer portion 100C while being borne on the intermediate transfer belt 506. The secondary transfer portion 100C is configured as a nip portion between the secondary transfer roller 56 as a transfer unit and the secondary transfer inner roller 503. A bias voltage having a polarity opposite to the charging polarity of the toner is applied to the secondary transfer roller 56, whereby the toner image is secondarily transferred to the sheet S. Residual toner remaining on the intermediate transfer belt 506 after the transfer is removed by a belt cleaner 508.

The sheet S to which the toner image has been transferred is delivered to the fixing unit 58 by the pre-fixing conveyance unit 57. The fixing unit 58 includes a fixing roller pair that nips and conveys the sheet S and a heat source such as a halogen heater, and applies pressure and heat to the toner image borne on the sheet S. As a result, the toner particles are melted and fixed, and the toner image is fixed on the sheet S.

Next, a sheet conveyance process of conveying a sheet will be described. A sheet conveyance system 100D as a sheet conveyance apparatus of the present embodiment conveys a sheet S fed from a sheet feeding unit 100B or a feeding deck 200 to be described later, and discharges the sheet S on which an image is formed to the outside of the apparatus body 100A. The sheet conveyance system 100D includes a sheet conveyance unit 54, a sheet detecting and conveying unit 50, a skew-feed correcting portion 55, a pre-fixing conveyance unit 57, a branch conveying portion 59, a reverse conveying portion 550, a retraction portion 501, and a duplex conveying portion 502.

The sheet cassette 51 provided in the sheet feeding unit 100B is attached to the apparatus body 100A so as to be able to be pulled out, and the sheet S is stored in a state of being stacked and supported on a lifting tray 52 that can be raised and lowered, and is fed one by one by the sheet feeding unit 53. Examples of the sheet feeding unit 53 include a belt system in which the sheet S is sucked to the belt member by a suction fan and conveyed, and a friction separation system using a roller or a pad. The sheet S fed from the sheet feeding unit 53 is conveyed along a feeding path 54*a* by a conveyance roller pair of the sheet conveyance unit 54, and is delivered to the skew-feed correcting portion 55 after the sheet is detected by the sheet detection sensor 5 in the sheet detecting and conveying unit 50. Note that the sheet S fed from the feeding deck 200 to be described in detail later is conveyed along a feeding path 54*c*, and thereafter, similarly, the sheet S is detected by the sheet detection sensor 5 in the sheet detecting and conveying unit 50 and then delivered to the skew-feed correcting portion 55.

The sheet S delivered to the skew-feed correcting portion 55 is conveyed toward the secondary transfer portion 100C after skew-feed correction and timing correction are performed. At this time, a registration roller pair 7 of the skew-feed correcting portion 55 sends the sheet S to the secondary transfer portion 100C at a timing corresponding to the progress of the image forming process by the image forming process units PY to PK based on the sheet detection timing by the sheet detection sensor 5. The sheet S to which the toner image has been transferred in the secondary transfer portion 100C and to which the image has been fixed by the fixing unit 58 is conveyed to the branch conveying portion 59 that branches the conveying path of the sheet S. When the image formation on the sheet S is completed, the sheet S is discharged to the sheet discharge tray 500 disposed outside the apparatus body 100A by a sheet discharge roller pair.

On the other hand, when an image is formed on the back surface of the sheet S, the sheet S is delivered to the duplex conveying portion 502 via the reverse conveying portion 550. The reverse conveying portion 550 includes a reverse conveyance roller pair capable of normal rotation and reverse rotation, and reverses the sheet by a switchback method of reversing the front and back of the sheet S. That is, the reverse conveying portion 550 retracts the leading edge of the sheet to the retraction portion 501, then reverses the conveying direction to reverse the front and back, and delivers the sheet to the duplex conveying portion 502. The duplex conveying portion 502 conveys the sheet S again toward the sheet detecting and conveying unit 50 and the skew-feed correcting portion 55 via the feeding path 54*b* of the sheet conveyance unit 54. Then, the sheet S is discharged to the sheet discharge tray 500 after an image is formed on the back surface.

Configuration of Feeding Deck

Figure 2:
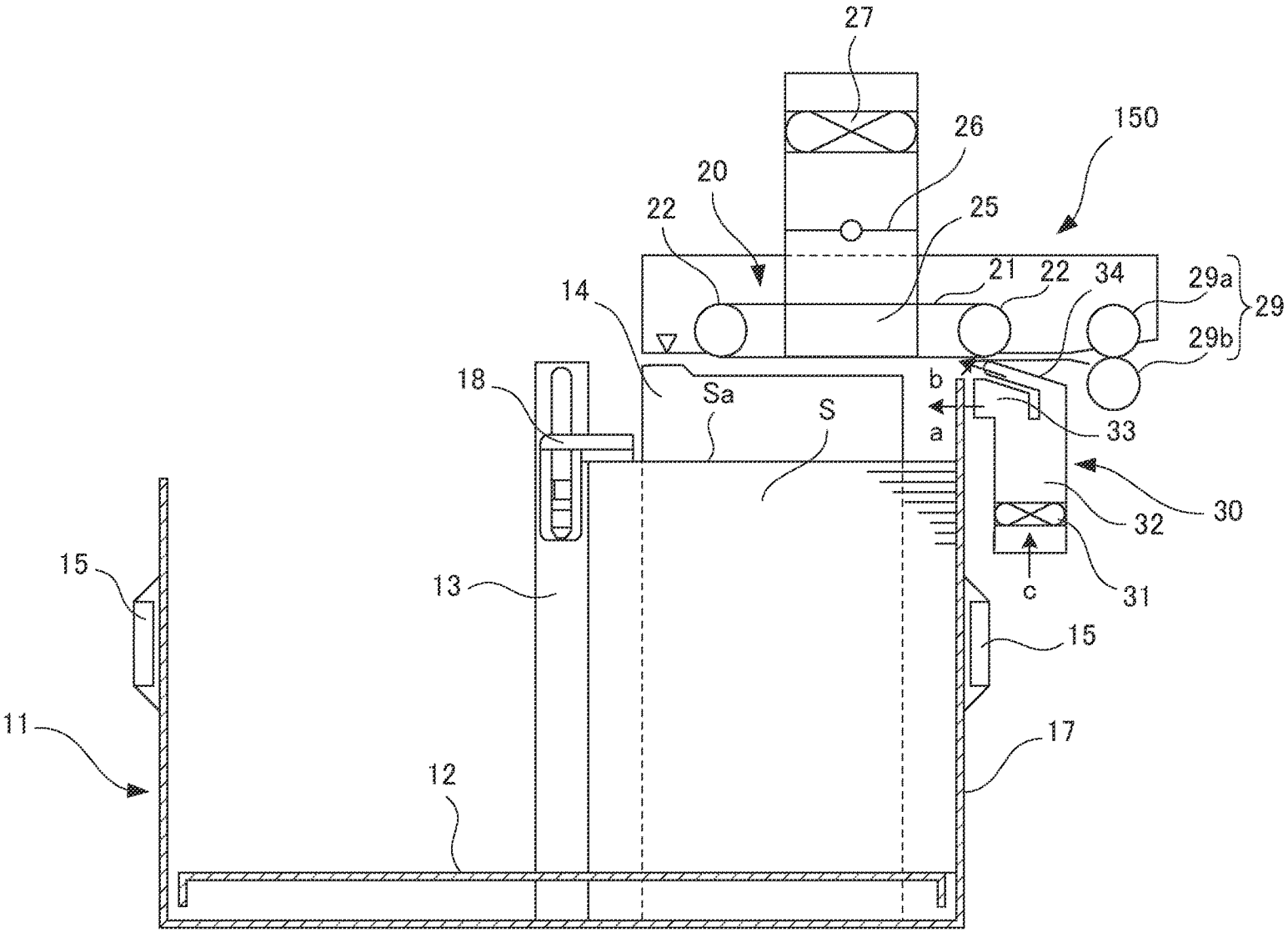
FIG. 2 is a schematic diagram illustrating a configuration of each sheet storage portion of a feeding deck and a periphery thereof according to the present embodiment.

Next, a configuration of the feeding deck 200 as a sheet feeding unit will be described with reference to FIGS. 1 and 2. FIG. 2 is a schematic diagram illustrating a configuration of each sheet storage portion of the feeding deck and a periphery thereof according to the present embodiment. As illustrated in FIG. 1, the feeding deck 200 is provided with three sheet storage portions 11 inside the apparatus body 200A, and sheets are stacked and supported on the lifting tray 12 in each sheet storage portion 11.

Specifically, as illustrated in FIG. 2, each of the sheet storage portions 11 includes the lifting tray 12 that can be raised and lowered, a trailing edge regulating plate 13, a leading edge regulating plate 17, and a side edge regulating plate 14. The leading edge regulating plate 17 abuts on a leading edge which is a downstream end in the sheet feeding direction of the sheet S stacked on the lifting tray 12 to regulate the position thereof. Further, the trailing edge regulating plate 13 is arranged to be movable in the sheet feeding direction, and abuts on a trailing edge which is an upstream end in the sheet feeding direction of the sheet S while sandwiching the sheet S stacked on the lifting tray 12 between the leading edge regulating plate 17 and the trailing edge regulating plate to regulate the position thereof. On the other hand, the side edge regulating plate 14 is arranged to be movable in the width direction orthogonal to the sheet feeding direction, and abuts on the end portion in the width direction of the sheet S to regulate the position thereof. That is, the positions of the trailing edge regulating plate 13 and the side edge regulating plate 14 can be arbitrarily changed according to the size of the stored sheet. Further, the trailing edge regulating plate 13 is provided with a trailing edge upper surface regulating portion 18 which regulates a height position of a trailing edge which is an upstream end portion of the uppermost sheet Sa in the sheet feeding direction so as to be movable in the vertical direction.

The sheet storage portion 11 can be pulled out from the apparatus body 200A by the slide rail 15, and when the sheet storage portion 11 is pulled out from the apparatus body 200A, the lifting tray 12 can be lowered to a predetermined position to replenish or replace the sheet. Note that the lifting tray 12 is raised or lowered by a lifter mechanism (not illustrated) including a lifter motor 12M (see FIG. 3) as a lifting unit such as a stepping motor or a DC servomotor.

An air sheet-feeding-type sheet feeding unit (hereinafter, referred to as an air feeding unit 150) for separating and feeding sheets one by one is disposed above the sheet storage portion 11. The air feeding unit 150 includes an attraction and conveyance unit 20 that attracts and conveys the sheet S stacked on the lifting tray 12, and an air blowing unit 30 that floats and loosens upper portions of a plurality of sheets S on the lifting tray 12 and separates the sheets S one by one.

The attraction and conveyance unit 20 includes an attraction and conveyance belt 21 that is stretched around a belt driving roller 22, attracts the sheet S, and feeds the sheet S in the right direction in the drawing, and an attraction fan 27 that generates a negative pressure for attracting the sheet S to the attraction and conveyance belt 21. The attraction duct 25 is disposed inside the attraction and conveyance belt 21 to suck air through a suction hole (not illustrated) formed in the attraction and conveyance belt 21. Further, an attraction shutter 26 that is disposed between the attraction fan 27 and the attraction duct 25 and turns on/OFF the attraction operation of the attraction and conveyance belt 21 is provided. As a result, it is possible to execute a feeding operation of attracting and feeding the floated sheet. In the present embodiment, a plurality of attraction and conveyance belts 21 are arranged at predetermined intervals in the width direction.

In addition, the air blowing unit 30 includes a loosening nozzle 33 and a separating nozzle 34 for blowing air to the upper front side of the stored sheet S, a loosening and separating fan 31, and a separating duct 32 for sending air from the loosening and separating fan 31 to the nozzles 33 and 34. Then, a part of the air sucked in the direction of arrow c by the loosening and separating fan 31 passes through the separating duct 32 and is blown in the direction of arrow a by the loosening nozzle 33, and some of the upper portions of the sheets S stacked on the lifting tray 12 are floated. The other air is blown in the direction of arrow b by the separating nozzle 34, and the floated sheets are separated one by one by the loosening nozzle 33. The separated uppermost sheet Sa is attracted to the attraction and conveyance belt 21, is fed one by one by the attraction and conveyance belt 21, and starts to be fed from the sheet storage portion 11 by a drawing roller pair 29 including a driving roller 29*a* and a driven roller 29*b*.

The sheet S started to be fed from the sheet storage portion 11 in this manner is fed to the feeding path 24 illustrated in FIG. 1, and detected by the sheet detection sensor 241 that detects the leading edge of the sheet S. The sheet S whose leading edge is detected by the sheet detection sensor 241 is temporarily stopped in the feeding path 24. Then, the sheet S starts to be fed in accordance with the image forming timing of the printer 100, and is sent to the feeding path 24*a* of the printer 100. As a result, it is possible to correct variations in conveyance timing generated in the air feeding unit 150.

Sheet Surface Sensor and Trailing Edge Sheet Surface Sensor

Figure 5:
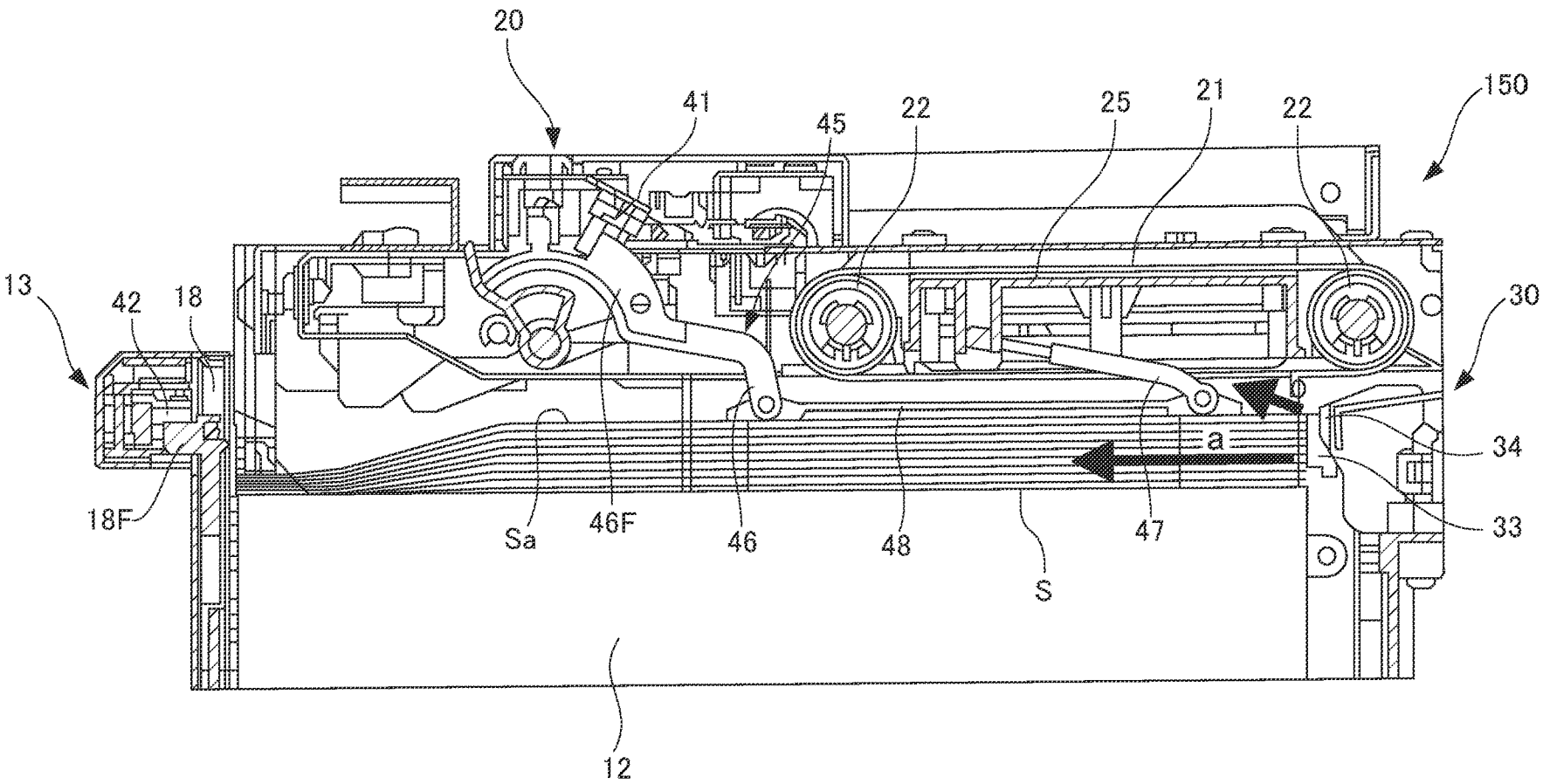
FIG. 5 is a cross-sectional view illustrating configurations of a sheet surface sensor and a trailing edge sheet surface sensor according to the present embodiment.

Next, a sheet surface sensor 41 that detects the upper surface of the uppermost sheet of the sheet bundle supported by the sheet storage portion 11 and a trailing edge sheet surface sensor 42 that detects the upper surface of the trailing edge of the sheet upstream in the feeding direction of the uppermost sheet will be described with reference to FIG. 5. FIG. 5 is a cross-sectional view illustrating configurations of the sheet surface sensor and the trailing edge sheet surface sensor according to the present embodiment.

As illustrated in FIG. 5, a sheet surface detection mechanism 45 is disposed above the lifting tray 12 of the sheet storage portion 11 so as to face the uppermost sheet Sa of the sheet bundle. The sheet surface detection mechanism 45 includes two pivoting levers 46 and 47 whose tips are vertically moved by pivoting, and a contact plate 48 that is supported by the pivoting levers 46 and 47 and abuts on the upper surface of the uppermost sheet Sa. That is, the sheet surface detection mechanism 45 constitutes a link mechanism that enables the contact plate 48 to move in the vertical direction while maintaining a horizontal state.

The sheet surface sensor 41 as an upper surface detection unit or a first upper surface sensor includes an optical sensor or the like that detects the presence or absence of a flag portion 46F of the pivoting lever 46. That is, the sheet surface sensor 41 is turned ON (detects the lower state) when the contact plate 48 in contact with the sheet Sa is below a reference position as a detection position (first detection position) and the pivot angle of the pivoting lever 46 exceeds a detection angle. Conversely, the sheet surface sensor 41 is turned OFF when the contact plate 48 in contact with the sheet Sa is above the reference position and the pivot angle of the pivoting lever 46 is smaller than the detection angle. As a result, the sheet surface sensor 41 can detect whether or not the position of the floated sheet Sa in the vertical direction is lower than the reference position. Note that the signal outputs of ON and OFF may be the opposite signal outputs, that is, a signal indicating whether or not the contact plate 48 is below the reference position may be output.

On the other hand, the trailing edge regulating plate 13 is provided with a trailing edge upper surface regulating portion 18 that abuts on the upper surface of the trailing edge of the uppermost sheet Sa supported by the lifting tray 12 and regulates floating of the trailing edge of the sheet Sa. The trailing edge upper surface regulating portion 18 is in contact with the trailing edge of the uppermost sheet Sa of the sheet bundle supported by the lifting tray 12 from above along the trailing edge regulating plate 13, and is supported so as to be raised and lowered integrally with the sheet Sa. As a result, the trailing edge upper surface regulating portion 18 follows the movement of the uppermost sheet Sa.

The trailing edge upper surface regulating portion 18 is provided with a flag portion 18F, and the trailing edge sheet surface sensor 42 as an upper surface detection unit or a second upper surface sensor includes an optical sensor or the like that detects the presence or absence of the flag portion 18F. Similarly, the trailing edge sheet surface sensor 42 is turned ON (detects the lower state) when the trailing edge upper surface regulating portion 18 abutting on the trailing edge of the sheet Sa is below the reference position as the detection position (second detection position). On the other hand, the trailing edge sheet surface sensor 42 is turned OFF when the trailing edge upper surface regulating portion 18 abutting on the trailing edge of the sheet Sa is above the reference position. As a result, the trailing edge sheet surface sensor 42 can detect whether or not the position of the trailing edge of the floated sheet Sa in the vertical direction is lower than the reference position. Similarly, the signal outputs of ON and OFF may be reversed, that is, a signal indicating whether or not the trailing edge upper surface regulating portion 18 is below the reference position may be output.

Configuration of Control System

Figure 3:
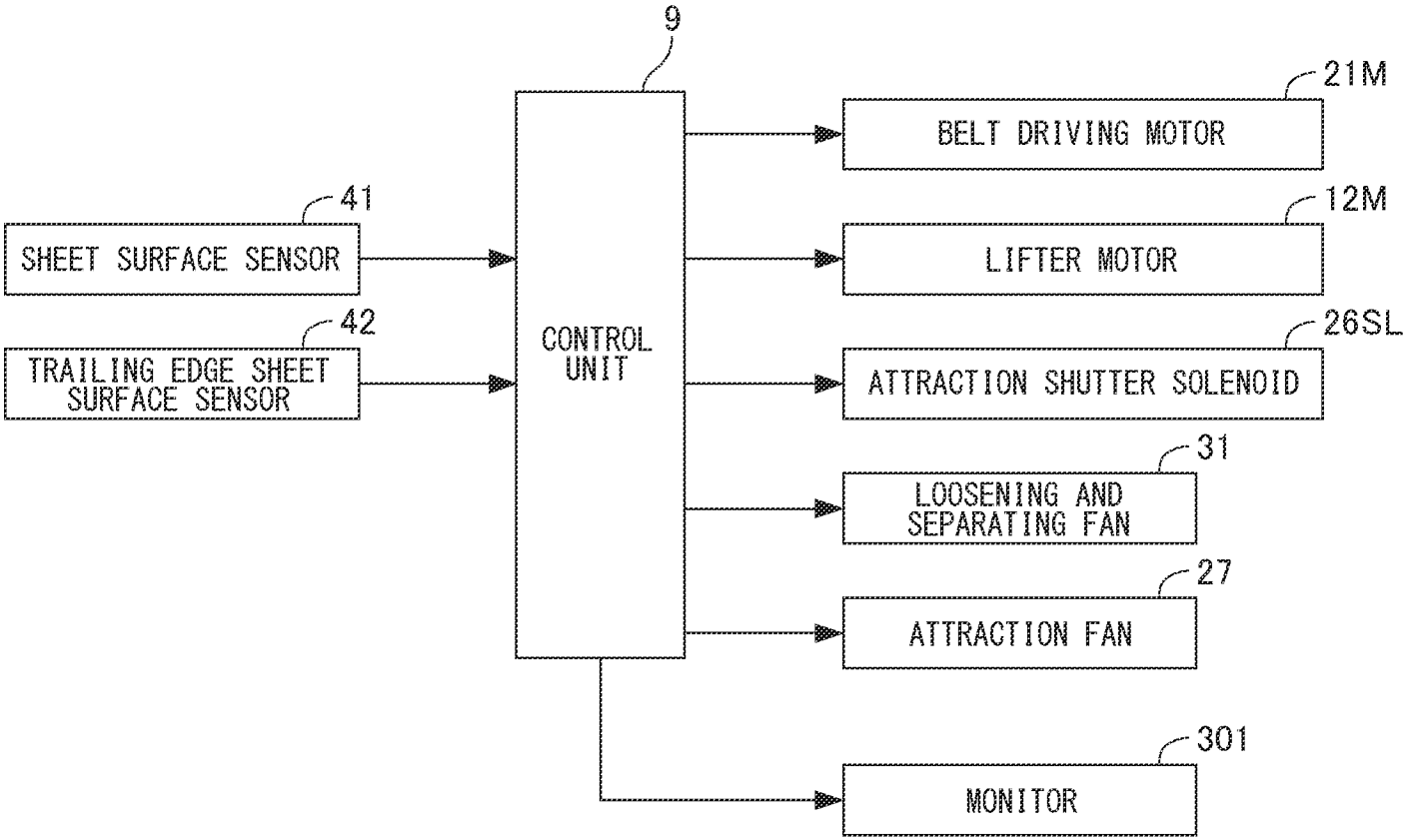
FIG. 3 is a block diagram illustrating a control system that controls the feeding deck according to the present embodiment.

Next, a configuration of a control system that controls the feeding deck 200 will be described with reference to FIG. 3. FIG. 3 is a block diagram illustrating a control system that controls the feeding deck according to the present embodiment. In the present embodiment, the control unit 9 will be described as being provided in the printer 100 as illustrated in FIG. 1, but the present invention is not limited thereto, and the control unit may be provided in the feeding deck 200. Furthermore, for example, the control unit 9 may be disposed in any device including a case where a processing device or the like is provided downstream in the sheet conveyance direction of the printer 100. That is, the control unit 9 may be disposed anywhere as long as the control unit 9 can communicate with the feeding deck 200 inside the image forming system 300.

The sheet surface sensor 41 and the trailing edge sheet surface sensor 42 described above are connected to the control unit 9, and ON/OFF signals thereof are input to the control unit 9. In addition, a belt driving motor 21M that drives the attraction and conveyance belt 21, a lifter motor 12M that raises and lowers the lifting tray 12, and an attraction shutter solenoid 26SL that rotates the attraction shutter 26 are connected to the control unit 9. Furthermore, the loosening and separating fan 31 that is provided in the air blowing unit 30 and blows air to the sheet, the attraction fan 27 that generates a negative pressure for attracting the floated sheet to the attraction and conveyance belt 21, and a monitor 301 (not illustrated in FIG. 1) are connected to the control unit 9.

Feeding Operation

Figure 4A:
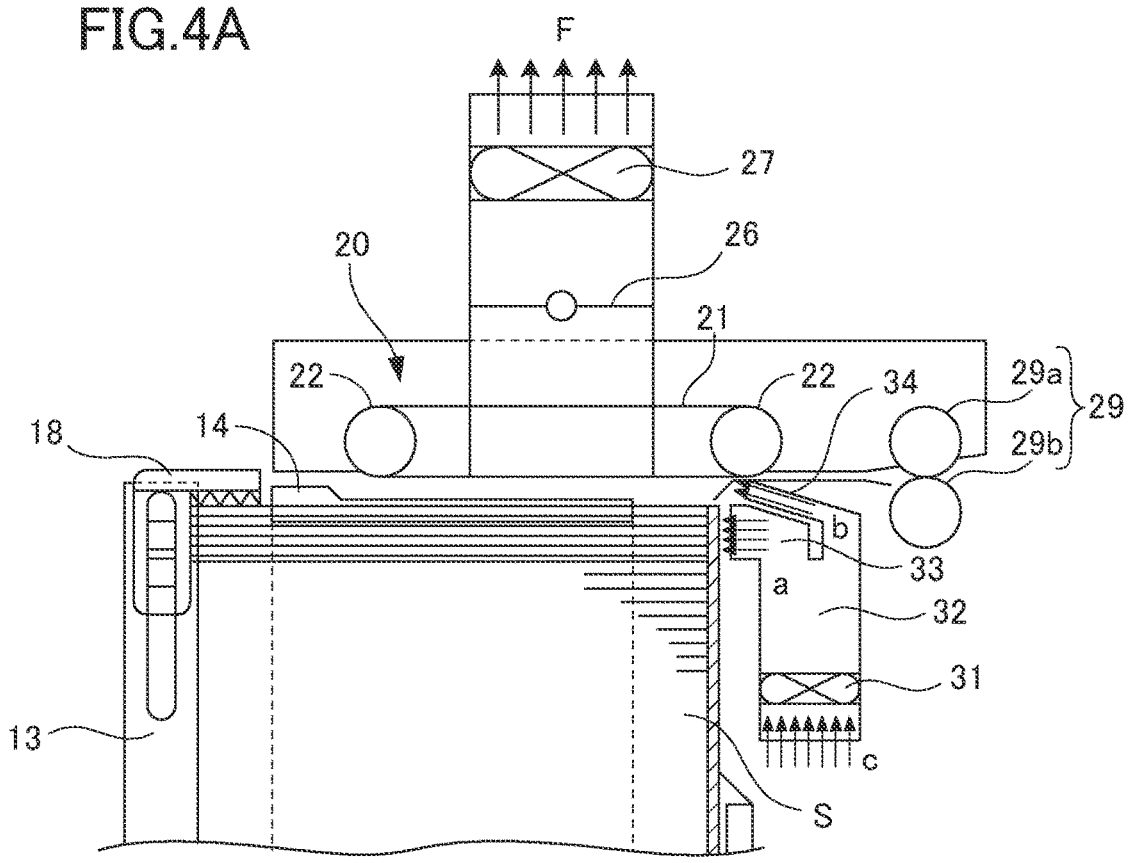
FIG. 4A is a schematic diagram illustrating an operation of floating a sheet in the feeding deck.
Figure 4B:
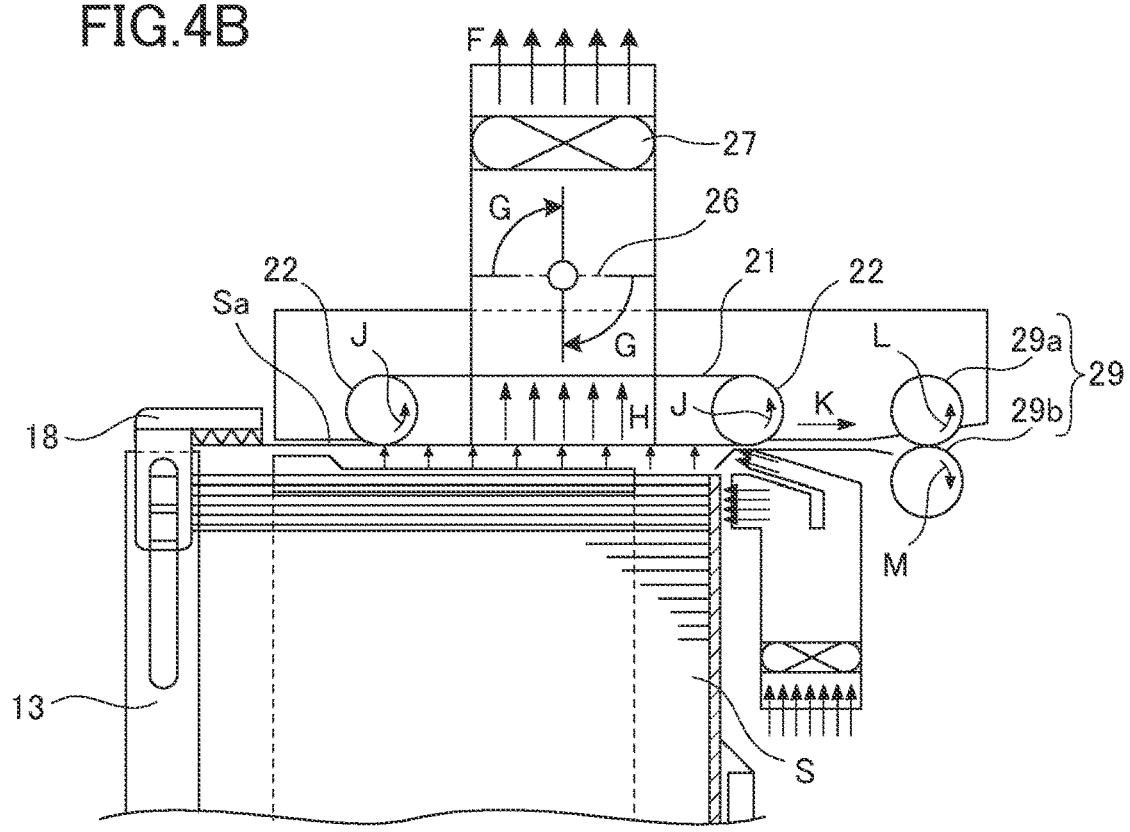
FIG. 4B is a schematic diagram for explaining an operation of attracting a sheet to an attraction and conveyance belt in the feeding deck.

Next, the feeding operation of the feeding deck 200 controlled by the control unit 9 will be described with reference to FIGS. 4A and 4B. FIG. 4A is a schematic diagram illustrating an operation of floating a sheet in the feeding deck. FIG. 4B is a schematic diagram for describing an operation of attracting the sheet to the attraction and conveyance belt in the feeding deck.

First, when a user pulls out the sheet storage portion 11 to set the sheet S (sheet bundle) and then stores the sheet storage portion 11 inside the apparatus body 200A, storage of the sheet storage portion 11 is detected by a sensor (not illustrated). Then, the control unit 9 drives the lifter motor 12M to raise the lifting tray 12, and when the lifting tray 12 reaches a position at which the distance between the supported sheet and the attraction and conveyance belt 21 becomes a distance where feeding is possible, the raising of the lifting tray 12 is stopped at this position. Then, the control unit 9 waits until a feeding start command is generated.

Thereafter, when start of an image forming job is instructed by an operation input from an operation unit (not illustrated) provided in the monitor 301 (see FIG. 3) or a signal from an external computer, a sheet feed signal is generated, and the control unit 9 starts a sheet feeding operation in response to the sheet feed signal. Then, as illustrated in FIG. 4A, the control unit 9 operates the loosening and separating fan 31 to suck air in the direction of arrow c. Then, the air is blown out from the loosening nozzle 33 and the separating nozzle 34 through the separating duct 32 and blown to the sheet in the directions indicated by arrows a and b. As a result, the upper several sheets S of the plurality of sheet bundles float. In addition, the control unit 9 operates the attraction fan 27 to discharge air in the direction of F in the drawing. At this time, the attraction shutter 26 is still closed.

Next, when a predetermined time elapses from the start of the sheet feeding operation (after receiving the sheet feed signal), floating of the upper sheet in the sheet bundle is stabilized. At this timing, the control unit 9 drives the attraction shutter solenoid 26SL (see FIG. 3) to rotate the attraction shutter 26 in the direction of arrow G as illustrated in FIG. 4B. As a result, air is sucked from the suction holes provided in the attraction and conveyance belt 21 in the direction of arrow H, and a sheet suction force is generated. Then, while only the uppermost sheet Sa is separated by the separation air from the separating nozzle 34, the uppermost sheet Sa is attracted to the attraction and conveyance belt 21 by the suction force.

Then, the control unit 9 drives the belt driving motor 21M (see FIG. 3) to rotate the belt driving roller 22 in the direction of arrow J. As a result, the uppermost sheet Sa is fed in the direction of arrow K in a state of being attracted to the attraction and conveyance belt 21. The sheet Sa is fed to a feeding path 24 (see FIG. 1) by a drawing roller pair 29 including a driving roller 29*a* driven in the direction of arrow L and a driven roller 29*b* driven in the direction of arrow M, and then fed to the image forming engine 513.

Raising Control of Lifting Tray

Next, raising control of the lifting tray 12 according to the present embodiment will be described with reference to FIGS. 6 to 9C.

The raising control of the lifting tray 12 according to the present embodiment includes first raising control and second raising control, and these can be selectively executed. The first raising control is executed, for example, when a first sheet having a second stiffness having a high stiffness such as cardboard is fed. The second raising control is executed, for example, when a second sheet having a first stiffness lower than the stiffness of a first sheet such as plain paper is fed. The control unit 9 selectively executes one of the first raising control and the second raising control based on a type of a sheet set by an operation unit (not illustrated) provided on the monitor 301, a type of a sheet set by an external computer, or the like. That is, the control unit 9 selects the first raising control when the sheet set in the sheet storage portion 11 is a type of sheet having high stiffness set in advance, and selects the second raising control when the sheet is a type of sheet having low stiffness set in advance.

Second Raising Control (Second Mode)

Figure 7:
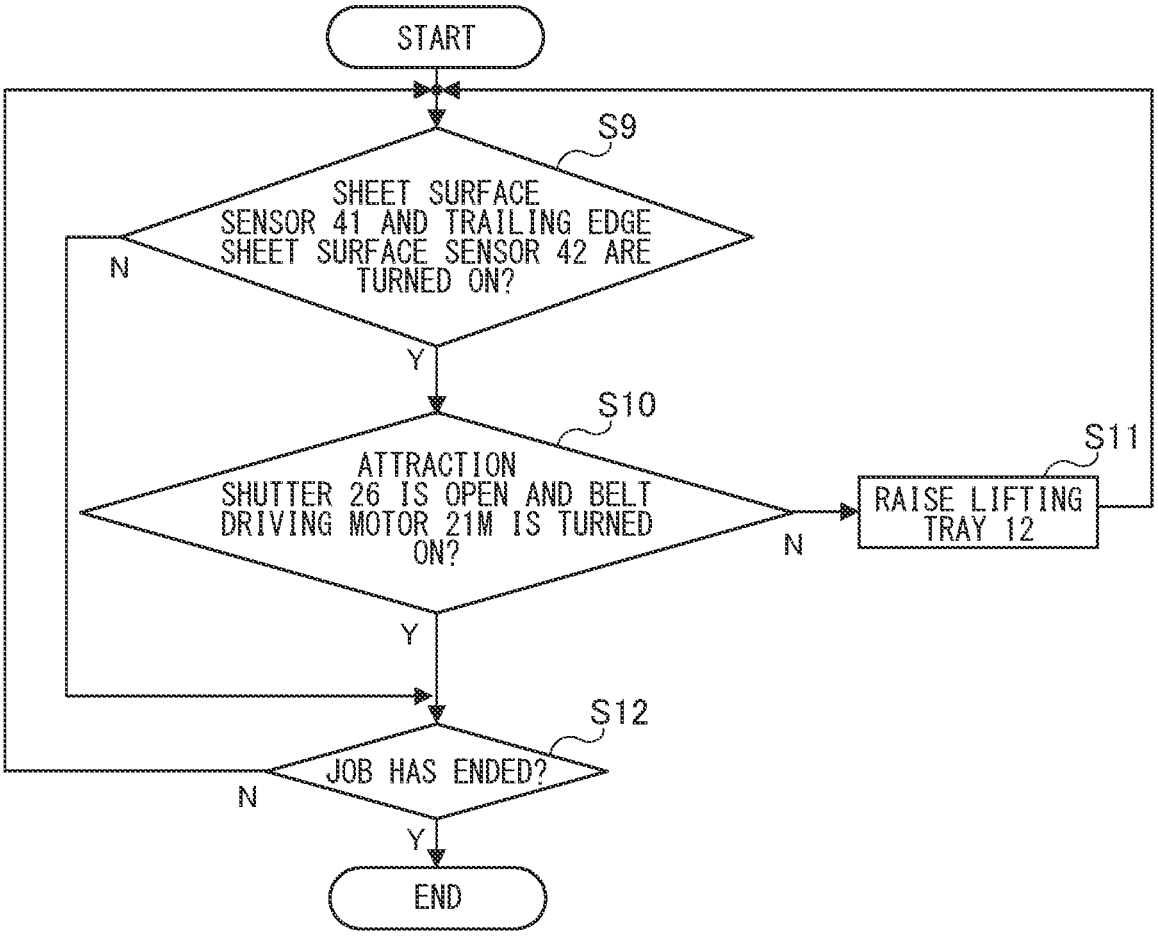
FIG. 7 is a flowchart illustrating second raising control of the lifting tray in the case of feeding a sheet having low stiffness according to the present embodiment.

First, the second raising control as the second mode in a case where a sheet having low stiffness such as plain paper is supported by the lifting tray 12 will be described with reference to FIG. 7. FIG. 7 is a flowchart illustrating second raising control of the lifting tray when a sheet having low stiffness is fed according to the present embodiment.

As described above, when the control unit 9 starts the second raising control and starts the sheet feeding operation (receives the sheet feed signal), the control unit 9 rotates the loosening and separating fan 31 to start blowing air to float the sheet. In this state, as illustrated in FIG. 7, it is determined whether or not the sheet surface sensor 41 and the trailing edge sheet surface sensor 42 are turned ON (S9), and if these sensors are turned OFF (N in S9), the process directly proceeds to step S12. Then, it is determined whether or not the image forming job has ended (S12), and in a case where the image forming job has not ended (N in S12) and sheet feeding is continuously required, the processing returns to step S9. When the image forming job ends (Y in S12), the second raising control ends.

On the other hand, when the sheet surface sensor 41 and the trailing edge sheet surface sensor 42 are turned ON (Y in S9) before the image forming job ends during the execution of the second raising control (N in S12), and it is detected that the height of the uppermost sheet Sa is lower than the reference position, the processing proceeds to step S10. In step S10, it is determined whether the attraction shutter 26 is open and the belt driving motor 21M is turned ON. That is, when the lifting tray 12 is raised in a state where the attraction shutter 26 is open and the attraction and conveyance belt 21 is driven, that is, in a state where the uppermost sheet Sa is fed, the floating state of the next sheet is disturbed. Therefore, when the attraction shutter 26 is open and the belt driving motor 21M is turned ON (Y in S10), the raising of the lifting tray 12 is prohibited, and the lifting tray 12 is not raised, and the processing proceeds to step S12. That is, the attraction and conveyance unit 20 is in the prohibited state during the sheet feeding operation. Similarly, in a case where the image forming job has not ended (N in S12) and sheet feeding is continuously required, the processing returns to step S9. When the image forming job ends (Y in S12), the second raising control ends.

On the other hand, when the attraction shutter 26 is not open and the belt driving motor 21M is turned OFF (N in S10), that is, since the uppermost sheet Sa is not being fed, the lifting tray 12 is brought into a permitted state in which raising is permitted, and the lifting tray 12 is raised (S11). That is, the attraction and conveyance unit 20 is in the permitted state while the sheet feeding operation is stopped. While the lifting tray 12 is raised in this manner, when the position of the uppermost sheet Sa is raised and the sheet surface sensor 41 and the trailing edge sheet surface sensor 42 are turned OFF (Nin S9), the raising of the lifting tray 12 is ended, and the processing proceeds to step S12. Similarly, in a case where the image forming job has not ended (N in S12) and sheet feeding is continuously required, the processing returns to step S9. When the image forming job ends (Y in S12), the second raising control ends.

Further, in step S11, after the raising of the lifting tray 12 is started, the sheet surface sensor 41 and the trailing edge sheet surface sensor 42 may enter the prohibited state (Y in S10) while remaining in the ON state (before OFF) (Y in S9). In this case, the processing proceeds to step S12, and the raising of the lifting tray 12 (S11) is interrupted and stopped. This prevents the floating state of the next sheet from being disturbed. Then, in a case where the image forming job has not ended (N in S12) and sheet feeding is continuously required, the processing returns to step S9. Thereafter, when the sheet surface sensor 41 and the trailing edge sheet surface sensor 42 remain in the ON state (Y in S9) and the permitted state is created (N in S10), the raising of the lifting tray 12 is resumed. That is, in the prohibited state, the raising of the lifting tray 12 is suspended, and after the permitted state is created, the suspended raising of the lifting tray 12 is resumed. Then, when the position of the uppermost sheet Sa rises and the sheet surface sensor 41 and the trailing edge sheet surface sensor 42 are turned OFF (N in S9), the raising of the lifting tray 12 is ended, and the processing proceeds to step S12. Similarly, in a case where the image forming job has not ended (Nin S12) and sheet feeding is continuously required, the processing returns to step S9. When the image forming job ends (Y in S12), the second raising control ends.

Operation Example in Second Raising Control (Second Mode)

Figure 9A:
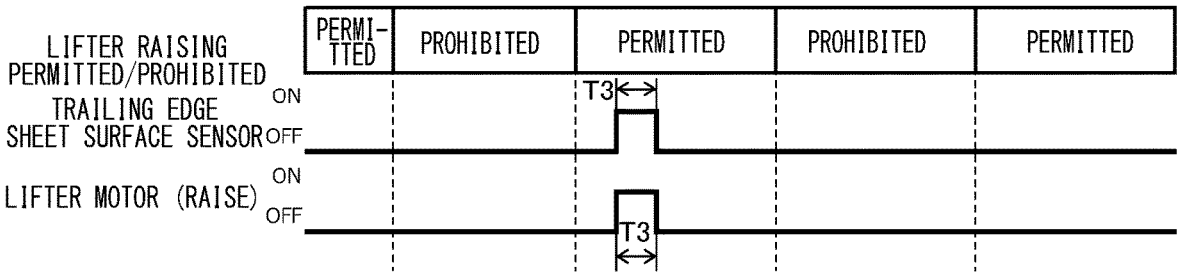
FIG. 9A is a time chart illustrating a case where the trailing edge sheet surface sensor is turned ON in the raising permitted state and the trailing edge sheet surface sensor is turned OFF in the raising permitted state in the second raising control.
Figure 9B:
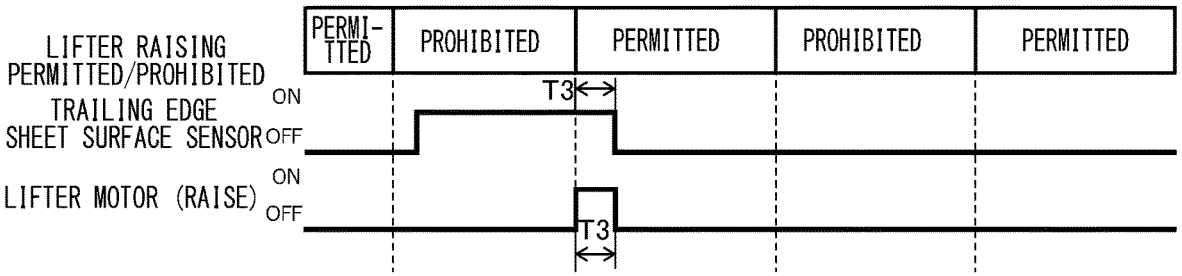
FIG. 9B is a time chart illustrating a case where the trailing edge sheet surface sensor is turned ON in the raising prohibited state and the lifting tray is raised after raising is permitted in the second raising control.
Figure 9C:
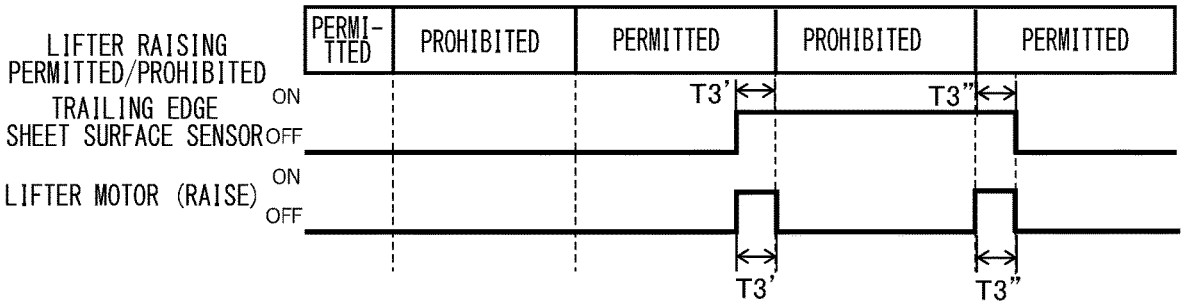
FIG. 9C is a time chart illustrating a case where raising is prohibited after the trailing edge sheet surface sensor is turned ON in the raising permitted state, and the lifting tray is raised after raising of the lifting tray is stopped and then raising is permitted in the second raising control.

Next, an operation example according to the second raising control will be described with reference to FIGS. 9A to 9C. FIG. 9A is a time chart illustrating a case where the trailing edge sheet surface sensor is turned ON in the raising permitted state and the trailing edge sheet surface sensor is turned OFF in the raising permitted state in the second raising control. FIG. 9B is a time chart illustrating a case where the trailing edge sheet surface sensor is turned ON in the raising prohibited state and the lifting tray is raised after raising is permitted in the second raising control. FIG. 9C is a time chart illustrating a case where raising is prohibited after the trailing edge sheet surface sensor is turned ON in the raising permitted state, and the lifting tray is raised after raising of the lifting tray is stopped and then raising is permitted in the second raising control.

In the description of this operation example, the trailing edge sheet surface sensor 42 is turned ON earlier than the sheet surface sensor 41 in most cases due to the sagging of the trailing edge of the sheet when the sheet floats, and thus only ON/OFF of the trailing edge sheet surface sensor 42 will be described. Further, as described above, when the attraction shutter 26 is open and the belt driving motor 21M is turned ON, this is a raising prohibited state in which raising of the lifting tray 12 is prohibited, and this is simply referred to as a "prohibited state". On the other hand, a case where the attraction shutter 26 is closed and the belt driving motor 21M is turned OFF is a raising permitted state in which raising of the lifting tray 12 is permitted, and this is simply referred to as a "permitted state".

As illustrated in FIG. 9A, when the trailing edge sheet surface sensor 42 is turned ON (see Y in S9), and the permitted state is created (see Nin S10), the lifter motor 12M is immediately turned ON (driven) to start raising the lifting tray 12 (see S11). When the trailing edge sheet surface sensor 42 is turned OFF after the detection time T3 from when the trailing edge sheet surface sensor 42 is turned ON in the permitted state (see N in S9), the lifter motor 12M is turned OFF to stop the raising of the lifting tray 12.

Here, for example, in a sheet having low stiffness such as plain paper, the trailing edge of the floated sheet is in a sagging state. Then, after the trailing edge of the sheet is located below the reference position and the trailing edge sheet surface sensor 42 is turned ON, when the lifting tray 12 is raised by, for example, about 0.09 mm corresponding to the thickness of one plain sheet, the trailing edge sheet surface sensor 42 is turned OFF. Therefore, at the raising speed of the lifting tray 12 in the present embodiment, the detection time T3 is, for example, about 15 ms.

Next, as illustrated in FIG. 9B, when the trailing edge sheet surface sensor 42 is turned ON (see Y in S9), and the prohibited state is created (see Y in S10), standby is performed until the permitted state is created (see N in S12 and Y in S9), that is, the raising of the lifting tray 12 is suspended. Thereafter, when the prohibited state is shifted to the permitted state (see N in S10), the lifter motor 12M is turned ON (driven) to start raising the lifting tray 12 (see S11). Then, when the trailing edge sheet surface sensor 42 is turned OFF after the detection time T3 from when the trailing edge sheet surface sensor 42 is turned ON in the permitted state (see Nin S9), the lifter motor 12M is turned OFF to stop the raising of the lifting tray 12.

Finally, as illustrated in FIG. 9C, when the trailing edge sheet surface sensor 42 is turned ON (see Y in S9), and the permitted state is created (see N in S10), the lifter motor 12M is immediately turned ON (driven) to start raising the lifting tray 12 (see S11). During the raising of the lifting tray 12, when the lifting tray is shifted from the permitted state to the prohibited state after the detection time T3', standby is performed until the permitted state is created (see N in S12 and Y in S9), that is, the raising of the lifting tray 12 is suspended. Thereafter, when the prohibited state is shifted to the permitted state (see N in S10), the lifter motor 12M is turned ON (driven), and the raising of the lifting tray 12 is resumed (see S11). Then, when the trailing edge sheet surface sensor 42 is turned OFF after the detection time T3" from when the trailing edge sheet surface sensor 42 is turned ON in the permitted state (see N in S9), the lifter motor 12M is turned OFF to stop the raising of the lifting tray 12.

Note that, here, the total time of the detection time T3' and the detection time T3" is the same as the detection time T3, for example, in the case of one sheet of plain paper. However, since the uppermost sheet Sa is fed in the prohibited state, the number of sheets is reduced by one sheet as compared with the case where the trailing edge sheet surface sensor 42 is turned ON in the permitted state. That is, for example, the upper surface position of the trailing edge of the sheet detected by the trailing edge sheet surface sensor 42 is lowered by two sheets of plain paper. Therefore, the total detection time of the detection time T3' and the detection time T3" is, for example, two sheets of plain paper, and is twice the detection time T3 (for example, about 30 ms).

As described above, in the second raising control (second mode), the raising of the lifting tray 12 is started in response to the ON of the trailing edge sheet surface sensor 42 in the permitted state, and the raising of the lifting tray 12 is stopped in response to the OFF of the trailing edge sheet surface sensor 42 in the permitted state. In the prohibited state, the raising of the lifting tray 12 is stopped or interrupted. When a sheet having low stiffness such that the trailing edge of the sheet sags is set on the lifting tray 12, the trailing edge sheet surface sensor 42 is turned ON/OFF according to the thickness of the sheet, so that the lifting tray 12 can be raised with satisfactory accuracy.

First Raising Control (First Mode)

Figure 6:
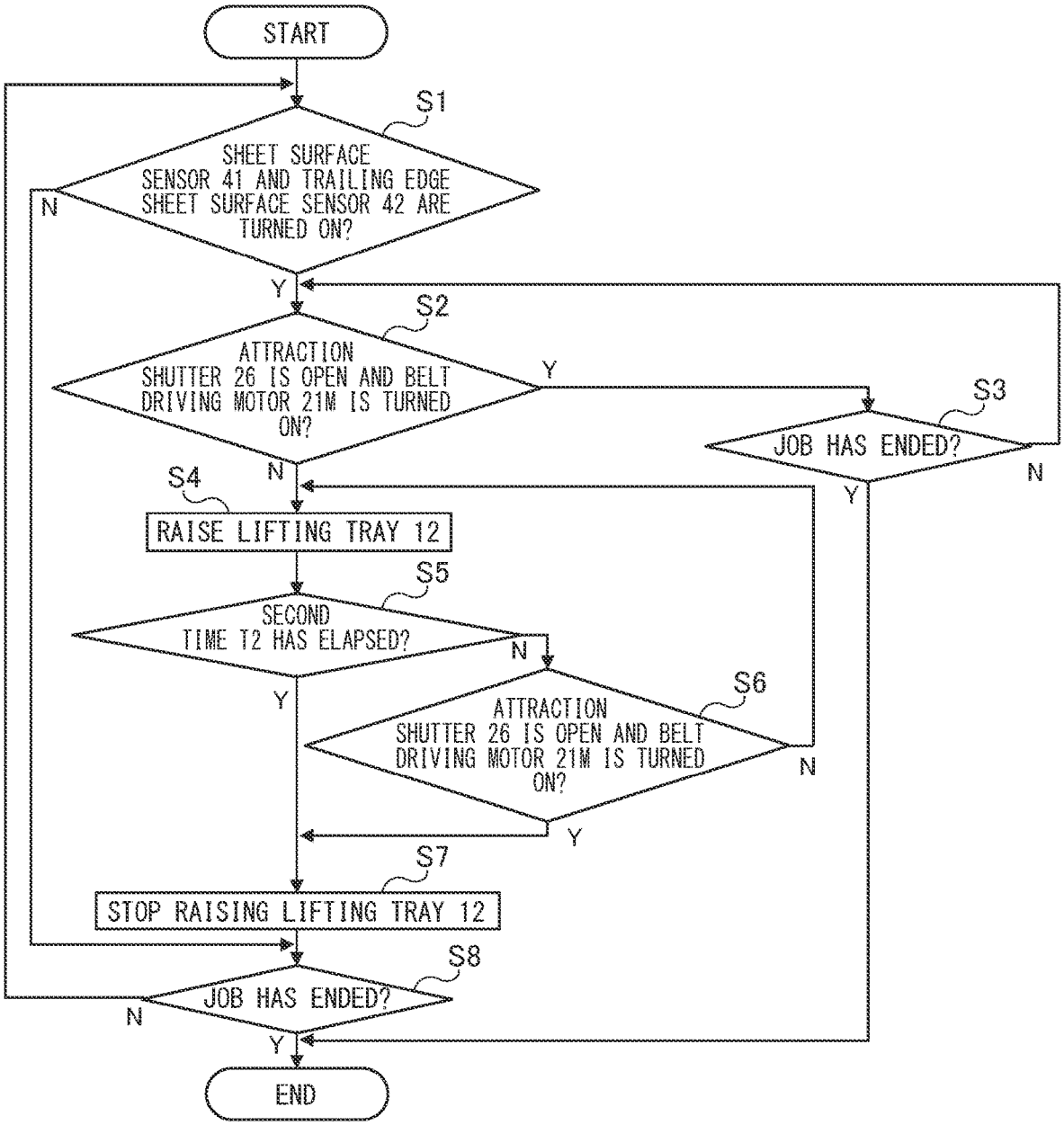
FIG. 6 is a flowchart illustrating first raising control of a lifting tray in the case of feeding a sheet having high stiffness according to the present embodiment.

Next, the first raising control as the first mode in a case where a sheet having high stiffness such as thick paper is supported by the lifting tray 12 will be described with reference to FIG. 6. FIG. 6 is a flowchart illustrating first raising control of the lifting tray in a case where a sheet having high stiffness is fed according to the present embodiment. Note that the thick paper used in the present embodiment will be described as having a grammage of 350 gsm or more, a thickness of about 0.35 to 0.5 mm, and a thickness of about 4 times to 5.5 times the thickness of the plain paper, but is not limited to such thick paper.

As described above, when the first raising control is started and the sheet feeding operation is started (a sheet feed signal is received), the control unit 9 rotates the loosening and separating fan 31 to start blowing air to float the sheet. In this state, as illustrated in FIG. 6, it is determined whether or not the sheet surface sensor 41 and the trailing edge sheet surface sensor 42 are turned ON (S1), and if these sensors are turned OFF (N in S1), the process directly proceeds to step S8. Then, it is determined whether or not the image forming job has ended (S8), and when the image forming job has not ended (Nin S8) and sheet feeding is continuously required, the processing returns to step S1. When the image forming job ends (Y in S8), the first raising control ends.

On the other hand, when the sheet surface sensor 41 and the trailing edge sheet surface sensor 42 are turned ON (Y in S1) before the image forming job ends during the execution of the first raising control (N in S8), that is, when it is detected that the height of the uppermost sheet Sa is lower than the reference position, the processing proceeds to step S2. In step S2, it is determined whether the attraction shutter 26 is open and the belt driving motor 21M is turned ON. That is, when the lifting tray 12 is raised in a state where the attraction shutter 26 is open and the attraction and conveyance belt 21 is driven, that is, in a state where the uppermost sheet Sa is fed, the floating state of the next sheet is disturbed. Therefore, when the attraction shutter 26 is open and the belt driving motor 21M is turned ON (Y in S2), the raising of the lifting tray 12 is prohibited, and the lifting tray 12 is not raised, and the processing proceeds to step S3. That is, the attraction and conveyance unit 20 is in the prohibited state during the sheet feeding operation. Similarly, in a case where the image forming job has not ended (N in S3) and sheet feeding is continuously required, the processing returns to step S1. When the image forming job ends (Y in S3), the first raising control ends.

On the other hand, when the attraction shutter 26 is not open and the belt driving motor 21M is turned OFF (Nin S2), that is, since the uppermost sheet Sa is not being fed, a permitted state is set in which the raising of the lifting tray 12 is permitted, and the raising of the lifting tray 12 is started (S4). That is, the attraction and conveyance unit 20 is in the permitted state while the sheet feeding operation is stopped. Subsequently, it is determined whether or not the second time T2 has elapsed since the sheet surface sensor 41 and the trailing edge sheet surface sensor 42 were turned ON (in other words, after the raising of the lifting tray 12 is started) as described above (S5). Until the second time T2 elapses (N in S5), it is determined whether the attraction shutter 26 is open and the belt driving motor 21M is turned ON (S6), that is, it is determined whether it is in the permitted state or the prohibited state. Here, in the permitted state (Nin S6), the lifting tray 12 is raised as itis (S4). Then, when the second time T2 elapses after the sheet surface sensor 41 and the trailing edge sheet surface sensor 42 are turned ON (Y in S5), the raising of the lifting tray 12 is stopped (S7), and the processing proceeds to step S8. When the image forming job has not ended (N in S8) and sheet feeding is continuously required, the processing returns to step S1. When the image forming job ends (Y in S8), the first raising control ends.

In addition, after the raising of the lifting tray 12 is started in step S4, before the second time T2 elapses (Nin S5), the prohibited state may occur (Y in S6). In this case, the raising of the lifting tray 12 (S7) is interrupted and stopped. This prevents the floating state of the next sheet from being disturbed. Then, in a case where the image forming job has not ended (Nin S8) and sheet feeding is continuously required, the processing returns to step S1. Thereafter, when the permitted state is created (N in S2) in a state where the sheet surface sensor 41 and the trailing edge sheet surface sensor 42 remain in the ON state (Y in S1), the raising of the lifting tray 12 is resumed (S4). That is, in the prohibited state, the raising of the lifting tray 12 is suspended, and after the permitted state is created, the suspended raising of the lifting tray 12 is resumed. Thereafter, when the second time T2 elapses (Y in S5), the raising of the lifting tray 12 ends (S7), and the processing proceeds to step S8. Similarly, in a case where the image forming job has not ended (N in S8) and sheet feeding is continuously required, the processing returns to step S1. When the image forming job ends (Y in S8), the first raising control ends.

Operation Example in First Raising Control (First Mode)

Figure 8A:
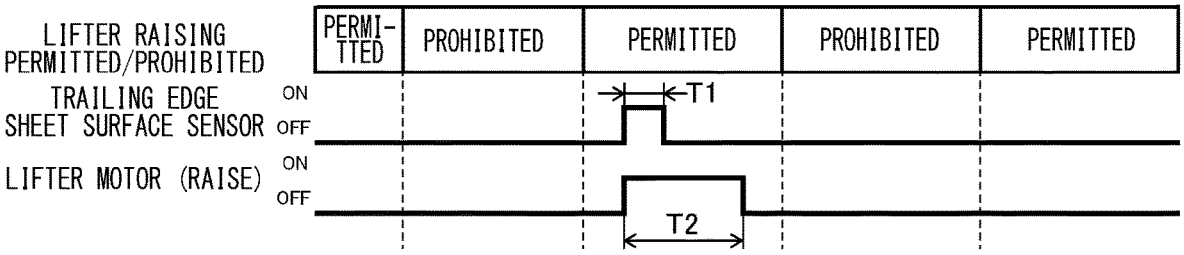
FIG. 8A is a time chart illustrating a case where the trailing edge sheet surface sensor is turned ON in the raising permitted state and raising of the lifting tray ends in the raising permitted state in the first raising control.
Figure 8B:
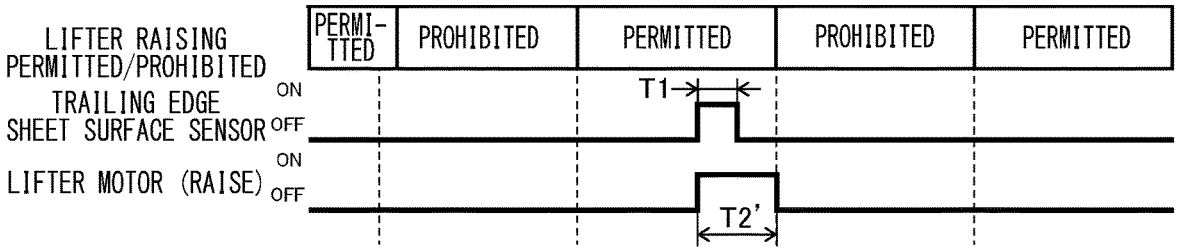
FIG. 8B is a time chart illustrating a case where the trailing edge sheet surface sensor is turned ON in the raising permitted state and the raising is prohibited while the lifting tray is being raised in the first raising control.
Figure 8C:
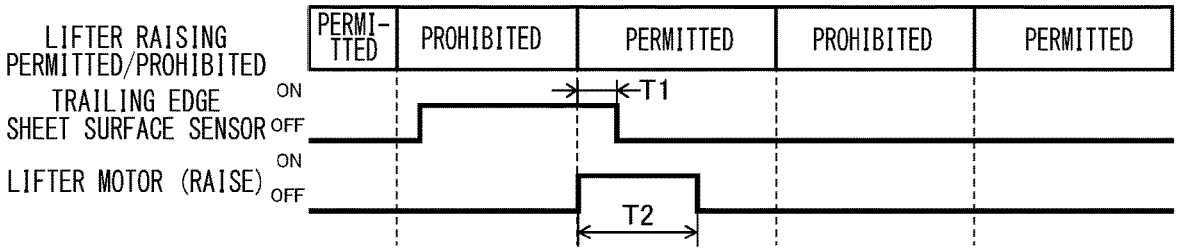
FIG. 8C is a time chart illustrating a case where the trailing edge sheet surface sensor is turned ON in the raising prohibited state and the lifting tray is raised after raising is permitted in the first raising control.
Figure 8D:
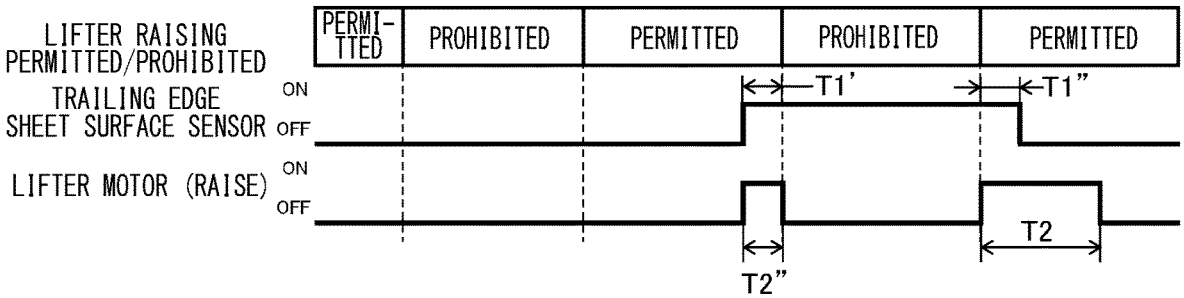
FIG. 8D is a time chart illustrating a case where raising is prohibited after the trailing edge sheet surface sensor is turned ON in the raising permitted state and the lifting tray is raised after raising of the lifting tray is stopped and then raising is permitted in the first raising control.

Next, an operation example according to the first raising control will be described with reference to FIGS. 8A to 8D. FIG. 8A is a time chart illustrating a case where the trailing edge sheet surface sensor is turned ON in the raising permitted state and raising of the lifting tray ends in the raising permitted state in the first raising control. FIG. 8B is a time chart illustrating a case where the trailing edge sheet surface sensor is turned ON in the raising permitted state and the raising is prohibited while the lifting tray is being raised in the first raising control. FIG. 8C is a time chart illustrating a case where the trailing edge sheet surface sensor is turned ON in the raising prohibited state and the lifting tray is raised after raising is permitted in the first raising control. FIG. 8D is a time chart illustrating a case where raising is prohibited after the trailing edge sheet surface sensor is turned ON in the raising permitted state and the lifting tray is raised after raising of the lifting tray is stopped and then raising is permitted in the first raising control.

Note that, also in the description of this operation example, the trailing edge sheet surface sensor 42 is mostly ON before the sheet surface sensor 41 due to the sagging of the trailing edge of the sheet when the sheet floats, and thus only ON/OFF of the trailing edge sheet surface sensor 42 will be described.

As illustrated in FIG. 8A, when the trailing edge sheet surface sensor 42 is turned ON (see Y in S1), and the permitted state is created (see Nin S2), the lifter motor 12M is immediately turned ON (driven) to start raising the lifting tray 12 (see S4). Then, after the elapse of the first time T1 (that is, the detection time in the case of thick paper) from when the trailing edge sheet surface sensor 42 is turned ON in the permitted state, the trailing edge sheet surface sensor 42 is turned OFF, but the lifter motor 12M is turned ON as it is and the lifting tray 12 continues to be raised. When the second time T2 elapses (see Y in S5), the lifter motor 12M is turned OFF to stop the raising of the lifting tray 12 (see S7).

Here, for example, in a sheet having stiffness higher than that of plain paper such as thick paper, the trailing edge of the floated sheet is less likely to sag. Therefore, when the lifting tray 12 is raised to some extent after the trailing edge of the sheet is located below the reference position and the trailing edge sheet surface sensor 42 is turned ON, the trailing edge sheet surface sensor 42 is turned OFF. That is, for example, the thickness of thick paper or the like is about 4 to 5.5 times that of plain paper as described above. Therefore, if the trailing edge of the sheet sags similarly to plain paper, the time during which the trailing edge sheet surface sensor 42 is turned ON is about 4 to 5.5 times, which is similar to the second time T2. However, since the trailing edge of the sheet hardly sags, when the lifting tray 12 starts to be raised, the trailing edge sheet surface sensor 42 is immediately turned OFF after the first time T1. Therefore, when the raising of the lifting tray 12 is stopped in response to the OFF of the trailing edge sheet surface sensor 42, the raising of the lifting tray 12 becomes insufficient, and the number of floating sheets becomes small, so that feeding failure of sheets occurs.

Therefore, in the first raising control, the lifting tray 12 is raised, that is, the raising time corresponding to the thickness of the cardboard is secured until the second time T2 (for example, about 60 ms to 82.5 ms) elapses after the trailing edge sheet surface sensor 42 is turned ON. As a result, it is possible to prevent the lifting tray 12 from being raised to an appropriate raising distance and the raising of the lifting tray 12 from becoming insufficient, and to reduce occurrence of feeding failure of sheets.

Next, as illustrated in FIG. 8B, when the trailing edge sheet surface sensor 42 is turned ON (see Y in S1) and the permitted state is created (see Nin S2), the lifter motor 12M is immediately turned ON (driven) to start raising the lifting tray 12 (see S4). Then, after the elapse of the first time T1 (that is, the detection time in the case of thick paper) from when the trailing edge sheet surface sensor 42 is turned ON in the permitted state, the trailing edge sheet surface sensor 42 is turned OFF, but the lifter motor 12M is turned ON as it is and the lifting tray 12 continues to be raised. Then, before the second time T2 elapses, when the trailing edge sheet surface sensor 42 is turned OFF and the prohibited state is created (see Nin S5, Y in S6), the lifter motor 12M is turned OFF to stop the raising of the lifting tray 12 (see S7).

In this case, when the lifting tray 12 is raised for a time T2' shorter than the second time T2, the lifting tray 12 is in the prohibited state and the raising of the lifting tray is interrupted. However, since the trailing edge sheet surface sensor 42 is turned OFF (see Nin S1), the raising of the lifting tray 12 ends. That is, there is a possibility that the raising amount of the lifting tray 12 is slightly less than the thickness of one piece of thick paper, but there is no problem since the timing at which the next trailing edge sheet surface sensor 42 is turned ON is advanced accordingly.

Next, as illustrated in FIG. 8C, when the trailing edge sheet surface sensor 42 is turned ON (see Y in S1), and the prohibited state is created (see Y in S2), standby is performed until the permitted state is created (see Nin S3, Y in S2), that is, the raising of the lifting tray 12 is suspended. Thereafter, when the prohibited state is shifted to the permitted state (see N in S2), the lifter motor 12M is turned ON (driven) to start raising the lifting tray 12 (see S4). Then, after the permitted state is created, the trailing edge sheet surface sensor 42 is turned OFF after the first time T1 (that is, the detection time at the time of thick paper), but the lifter motor 12M is turned ON as it is and the lifting tray 12 continues to be raised. Then, when the second time T2 elapses after the trailing edge sheet surface sensor 42 is turned ON in the permitted state (see Y in S5), the lifter motor 12M is turned OFF to stop the raising of the lifting tray 12 (see S7).

As described above, when the lifting tray 12 is raised in the prohibited state while the uppermost sheet Sa is being fed, the floating state of the next sheet may be disturbed. However, by delaying the raising of the lifting tray 12 until the permitted state is created, the floating state of the sheet is not disturbed, and the lifting tray 12 can be raised by an appropriate distance with respect to the thickness of one thick sheet.

Finally, as illustrated in FIG. 8D, in a case where the trailing edge sheet surface sensor 42 is turned ON (see Y in S1), and the permitted state is created (see N in S2), the lifter motor 12M is immediately turned ON (driven) to start raising the lifting tray 12 (see S4). When the lifting tray 12 shifts from the permitted state to the prohibited state in the detection time T1," that is, after the rise time T2," during raising of the lifting tray 12, raising of the lifting tray 12 is interrupted and stopped (see S7). Then, the standby is performed until a permitted state is created (see Nin S8, Y in S1, Y in S2, Nin S3), that is, raising of the lifting tray 12 is suspended while being interrupted. Thereafter, when the prohibited state is shifted to the permitted state (see N in S2), the lifter motor 12M is turned ON to resume raising of the lifting tray 12 (see S4). Then, after the elapse of the detection time T1" from the permitted state, the trailing edge sheet surface sensor 42 is turned OFF, but the lifter motor 12M is turned ON as it is and the lifting tray 12 continues to be raised. Then, when the second time T2 elapses after the trailing edge sheet surface sensor 42 is turned ON in the permitted state (see Y in S5), the lifter motor 12M is turned OFF to stop the raising of the lifting tray 12 (see S7).

In this case, the lifting tray 12 is raised for the time T2", but since the uppermost sheet Sa is fed in the prohibited state, the number of sheets is reduced by one as compared with the case where the trailing edge sheet surface sensor 42 is turned ON in the permitted state. That is, for example, there is no problem even if the lifting tray 12 is raised by two sheets of thick paper. In addition, there is a possibility that the raising amount of the lifting tray 12 is slightly less than the thickness of two sheets of thick paper, but there is no problem since the timing at which the next trailing edge sheet surface sensor 42 is turned ON is advanced accordingly.

As described above, in the first raising control (first mode), raising of the lifting tray 12 is started in response to ON of the trailing edge sheet surface sensor 42 in the permitted state, and raising of the lifting tray 12 is stopped in response to elapse of the second time T2 in the permitted state. In the prohibited state, the raising of the lifting tray 12 is stopped or interrupted. In a case where a sheet having high stiffness in which the trailing edge of the sheet is less likely to sag is set on the lifting tray 12, there is a possibility that the sheet is immediately turned OFF after the trailing edge sheet surface sensor 42 is turned ON. However, for example, the lifting tray 12 can be raised by an appropriate distance with respect to the thickness of the cardboard.

Possibility of Other Embodiments

In the first raising control according to the present embodiment, the lifting tray 12 is raised until the second time T2 elapses after the sheet surface sensor 41 and the trailing edge sheet surface sensor 42 are turned ON. However, the present invention is not limited thereto, and the lifting tray 12 may be raised until a set time elapses after the sheet surface sensor 41 and the trailing edge sheet surface sensor 42 are turned ON and the sheet surface sensor 41 and the trailing edge sheet surface sensor 42 are turned OFF.

In the present embodiment, the control unit 9 selects one of the first raising control and the second raising control according to the type of the sheet. However, the present invention is not limited thereto, and the raising control may be selected according to parameters such as the thickness, grammage, and stiffness of the sheet. In addition, the second time T2 in the first raising control may be changed in accordance with these parameters.

In addition, in the present embodiment, it has been described that the prohibited state is created when the attraction shutter 26 is open and the belt driving motor 21M is turned ON, and conversely, the permitted state is created when the attraction shutter 26 is closed and the belt driving motor 21M is turned OFF. However, the present invention is not limited thereto, and the prohibited state may be created when any one of the case where the attraction shutter 26 is open and the case where the belt driving motor 21M is turned ON is satisfied. On the other hand, the permitted state may be created when any one of the case where the attraction shutter 26 is closed and the case where the belt driving motor 21M is turned OFF is satisfied. That is, the establishment conditions of the prohibited state and the permitted state may be any conditions as long as the position of the floated sheet is not disturbed.

Further, in the present embodiment, the description has been given of the condition that the raising of the lifting tray 12 is started when both the sheet surface sensor 41 and the trailing edge sheet surface sensor 42 are turned ON. However, since the trailing edge of the sheet is likely to sag, the raising of the lifting tray 12 may be started only when the trailing edge sheet surface sensor 42 is turned ON. In addition, ON and OFF of these sensors are merely to detect a change in a signal, and the sensor may be turned OFF when the sensor is below the reference position.

Further, in the present embodiment, it has been described that the reference position where the signals of the sheet surface sensor 41 and the trailing edge sheet surface sensor 42 change is set in accordance with the case of a sheet having low stiffness such as plain paper, for example. However, the present invention is not limited thereto, and the reference position at which the signals of the sheet surface sensor 41 and the trailing edge sheet surface sensor 42 change may be set in accordance with a case of a sheet having high stiffness such as thick paper. In this case, for example, the sagging of the trailing edge of a sheet having low stiffness such as plain paper is earlier than the sagging of the trailing edge of a sheet having high stiffness such as thick paper, that is, the timing of the change in the signal of the trailing edge sheet surface sensor 42 is earlier. Therefore, for example, the second raising control is performed when a sheet having high stiffness such as thick paper is set, and the first raising control is performed when a sheet having low stiffness such as plain paper is set. Then, it is conceivable to make the second time T2 shorter than the first time T1 (shorter than the detection time in the case of plain paper or the like). In short, it is conceivable that the raising of the lifting tray 12 is started in response to the output of the ON signal from the trailing edge sheet surface sensor 42, and the raising of the lifting tray is stopped in response to the elapse of the set time set in accordance with the thickness of the sheet.

In the present embodiment, the image forming system 300 including the feeding deck 200 as the sheet feeding unit has been described. The sheet feeding apparatus may include the feeding deck 200 and the control unit 9 of the printer 100. Further, for example, the sheet feeding apparatus may include the sheet feeding unit 100B provided in the printer 100 and the control unit 9. Furthermore, the control unit 9 of the sheet feeding apparatus is not limited to the one provided in the printer 100, and may be provided in the feeding deck 200. Furthermore, the control unit may be provided in each of the printer 100 and the feeding deck 200. In particular, the control unit may be provided in any part of the image forming system 300.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-077708, filed on May 10, 2022, which is hereby incorporated by reference herein in its entirety.

What is claimed is:

1. A sheet feeding apparatus comprising:

a tray configured to be raised and lowered and support a sheet;

a lifting unit configured to raise and lower the tray;

an air blowing unit configured to blow air to a side edge of the sheet supported by the tray to float the sheet;

an attraction and conveyance unit configured to execute a feeding operation of attracting and feeding the floated sheet;

an upper surface detection unit configured to detect a lower state where an upper surface of the sheet is below a detection position; and a control unit configured to control the lifting unit and the attraction and conveyance unit, wherein the control unit is configured to execute a mode in which the tray is raised by the lifting unit for a second time longer than a first time in which the lower state is detected.

2. The sheet feeding apparatus according to claim 1, wherein the control unit is configured to set a prohibited state in which raising of the tray by the lifting unit is prohibited and a permitted state in which raising of the tray by the lifting unit is permitted, and in a case where the upper surface detection unit detects the lower state in the prohibited state during execution of the mode, the tray is raised for the second time after the tray enters the permitted state.

3. The sheet feeding apparatus according to claim 2, wherein the raising of the tray is stopped in a case where the tray is shifted from the permitted state to the prohibited state while the tray is being raised during the execution of the mode.

4. The sheet feeding apparatus according to claim 2, wherein the prohibited state is a state in which the feeding operation by the attraction and conveyance unit is in execution, and the permitted state is a state in which the feeding operation by the attraction and conveyance unit is stopped.

5. The sheet feeding apparatus according to claim 1, wherein the mode is a first mode, and the control unit is configured to execute a second mode in which the tray is raised by the lifting unit for the first time.

6. The sheet feeding apparatus according to claim 5, wherein the first mode is executed in a case where a stiffness of the sheet supported by the tray is a second stiffness higher than a first stiffness, and the second mode is executed in a case where the stiffness of the sheet supported by the tray is the first stiffness.

7. The sheet feeding apparatus according to claim 1, wherein the upper surface detection unit is disposed upstream of the air blowing unit in a sheet feeding direction.

8. The sheet feeding apparatus according to claim 1, wherein the upper surface detection unit includes a first upper surface sensor that is disposed above the tray and detects an upper surface of a floated sheet, and a second upper surface sensor that is disposed upstream of the first upper surface sensor in a sheet feeding direction and detects the upper surface of the floated sheet, and in a case where the first upper surface sensor detects that the upper surface of the floated sheet is below a first detection position and the second upper surface sensor detects that the upper surface of the floated sheet is below a second detection position, the lower state is detected.

9. A sheet feeding apparatus comprising:

a tray configured to be raised and lowered and support a sheet;

a lifting unit configured to raise and lower the tray;

an air blowing unit configured to blow air to a side edge of the sheet supported by the tray to float the sheet;

an attraction and conveyance unit configured to execute a feeding operation of attracting and feeding the floated sheet;

an upper surface detection unit configured to output a signal indicating that an upper surface of the floated sheet is below a detection position; and a control unit configured to control the lifting unit and the attraction and conveyance unit, wherein the control unit is configured to execute a mode in which the lifting unit starts raising the tray in response to the output of the signal and stops raising the tray in response to elapse of a set time set in accordance with a thickness of the sheet.

10. An image forming system comprising:

a sheet feeding unit including:

a tray configured to be raised and lowered and support a sheet;

a lifting unit that raises and lowers the tray;

an air blowing unit that blows air to a side edge of the sheet supported by the tray to float the sheet, an attraction and conveyance unit configured to execute a feeding operation of attracting and feeding the floated sheet; and an upper surface detection unit that detects a lower state where an upper surface of a sheet is below a detection position; and an image forming apparatus including:

an image forming unit that forms an image on a sheet fed from the attraction and conveyance unit; and a control unit that controls the lifting unit and the attraction and conveyance unit, wherein the control unit is configured to execute a mode in which the tray is raised by the lifting unit for a second time longer than a first time in which the lower state is detected.

11. An image forming apparatus comprising:

a sheet feeding unit including:

a tray configured to be raised and lowered and support a sheet;

a lifting unit that raises and lowers the tray;

an air blowing unit that blows air to a side edge of the sheet supported by the tray to float the sheet;

an attraction and conveyance unit configured to execute a feeding operation of attracting and feeding the floated sheet; and an upper surface detection unit that detects a lower state where an upper surface of a sheet is below a detection position;

an image forming unit configured to form an image on a sheet fed from the attraction and conveyance unit; and a control unit configured to control the lifting unit and the attraction and conveyance unit, wherein the control unit is configured to execute a mode in which the tray is raised by the lifting unit for a second time longer than a first time in which the lower state is detected.

* * * * *